US010040312B2

(12) United States Patent
Orem et al.

(10) Patent No.: US 10,040,312 B2
(45) Date of Patent: Aug. 7, 2018

(54) ROLLER-BALL PAINT MARKER

(71) Applicant: CRAYOLA, LLC, Easton, PA (US)

(72) Inventors: Christopher P. Orem, Easton, PA (US); Robert N. Amabile, Bangor, PA (US); Victor Bedoya, Easton, PA (US); Jordan Howell, Easton, PA (US); Roseld V. Laguatan, Jr., Bath, PA (US); John D. McBride, Jr., Easton, PA (US); Douglas Melville, Simsbury, CT (US); Leena Vadaketh, Doylestown, PA (US)

(73) Assignee: Crayola, LLC, Easton, PA (US)

( * ) Notice: Subject to any disclaimer, the term of this patent is extended or adjusted under 35 U.S.C. 154(b) by 39 days.

(21) Appl. No.: 15/352,285

(22) Filed: Nov. 15, 2016

(65) Prior Publication Data

US 2017/0136804 A1 May 18, 2017

Related U.S. Application Data

(60) Provisional application No. 62/255,816, filed on Nov. 16, 2015.

(51) Int. Cl.
*B43K 7/10* (2006.01)
*B43K 8/20* (2006.01)
(Continued)

(52) U.S. Cl.
CPC ..... *B43K 8/20* (2013.01); *B43K 8/003* (2013.01); *B43K 8/022* (2013.01); *B43K 8/024* (2013.01); *B43K 8/03* (2013.01); *B43K 15/00* (2013.01)

(58) Field of Classification Search
CPC ..... B43K 8/20; B43K 8/022; B43K 8/024
(Continued)

(56) References Cited

U.S. PATENT DOCUMENTS 554,189 A 2/1896 Kochendarfer
720,705 A 2/1903 La Burt
(Continued)

FOREIGN PATENT DOCUMENTS

DE 102013009804 B4 6/2015
EP 1083130 A1 3/2001
(Continued)

OTHER PUBLICATIONS

International Search Report and Written Opinion dated Jan. 24, 2017 in International Patent Application No. PCT/US2016/062206, 8 pages.

*Primary Examiner* — Jennifer C Chiang
(74) *Attorney, Agent, or Firm* — Shook, Hardy & Bacon L.L.P.

(57) ABSTRACT

Embodiments of the invention are directed to a roller ball marking instrument for use with paint, a method for assembling the roller ball marking instrument, and a system for delivering paint. The body of the marking instrument includes a reservoir for storing paint. The body is coupled to a fibrous roller ball via a retaining ring. The roller balls sits within a partially-enclosed cavity in the center of the retaining ring. A least part of the roller ball protrudes through an opening in the retaining ring. Paint in the reservoir moves first through an opening at one end of the body and then through an open center of the retaining ring. The paint is transferred to the roller ball. The roller ball rotates freely within the cavity of the retaining ring and transfers the paint to a writing surface.

18 Claims, 13 Drawing Sheets

(51) Int. Cl.

| | |
|---|---|
| ***B43K 8/02*** | (2006.01) |
| ***B43K 8/00*** | (2006.01) |
| ***B43K 8/03*** | (2006.01) |
| ***B43K 15/00*** | (2006.01) |

(58) Field of Classification Search
USPC ..... 201/213, 216
See application file for complete search history.

(56) References Cited

U.S. PATENT DOCUMENTS

| | | | | |
|---|---|---|---|---|
| 1,485,181 | A | | 2/1924 | Grund |
| 2,749,566 | A | | 6/1956 | Thomas |
| 2,923,957 | A | | 2/1960 | Gentile |
| 2,937,395 | A | | 5/1960 | Williams |
| 3,010,139 | A | | 11/1961 | Parker |
| 3,658,432 | A | | 4/1972 | Lanusse |
| 4,021,125 | A | | 5/1977 | Berghahn et al. |
| D271,028 | S | | 10/1983 | Adams |
| 4,940,350 | A | | 7/1990 | Kim |
| 5,051,017 | A | | 9/1991 | Yorks |
| D346,112 | S | | 4/1994 | Alcindor |
| 5,937,866 | A | | 8/1999 | Magharehi |
| 6,053,650 | A | | 4/2000 | Bennett et al. |
| 6,095,708 | A | | 8/2000 | Butaud |
| 6,155,736 | A | * | 12/2000 | Evans ..... A45D 40/261 401/209 |
| 6,488,429 | B2 | | 12/2002 | Korper |
| D474,685 | S | | 5/2003 | Finley |
| 6,572,297 | B2 | | 6/2003 | Korper |
| 6,712,539 | B2 | | 3/2004 | Richard et al. |
| 7,070,352 | B2 | * | 7/2006 | Iida ..... B43K 5/005 401/192 |
| 7,117,818 | B2 | * | 10/2006 | Pappas ..... A01K 1/0356 119/72.5 |
| 8,596,220 | B2 | | 12/2013 | Mainini |
| 8,851,778 | B2 | | 10/2014 | Neto et al. |
| 8,899,863 | B2 | | 12/2014 | Geiger et al. |
| 2004/0005186 | A1 | | 1/2004 | Ueda et al. |
| 2005/0169693 | A1 | | 8/2005 | Serio et al. |
| 2005/0249540 | A1 | | 11/2005 | Gueret |
| 2008/0003052 | A1 | | 1/2008 | Lee et al. |

FOREIGN PATENT DOCUMENTS

| | | | |
|---|---|---|---|
| GB | 2082124 | A | 1/1984 |
| GB | 2478347 | A | 9/2011 |

* cited by examiner

ROLLER-BALL PAINT MARKER

CROSS-REFERENCE TO RELATED APPLICATIONS

This application claims the benefit of U.S. Provisional Application No. 62/255,816, entitled "ROLLER-BALL PAINT MARKER," filed on Nov. 16, 2015, which is incorporated by reference in its entirety.

SUMMARY

Embodiments of the invention are defined by the claims below, not this summary. A high-level overview of various aspects of the invention provides an overview of the disclosure and introduces a selection of concepts that are further described in the detailed description section below. This summary is not intended to identify key or essential features of the claimed subject matter or to be used as an aid in isolation to determine the scope of the claimed subject matter.

In brief and at a high level, this disclosure describes, among other things, a marking instrument designed to deliver paint, such as Crayola® Sidewalk Paint, to outdoor surfaces such as sidewalks. In one aspect, the roller-ball chalk marking instrument includes a compressible plastic body; a fibrous, spherical roller ball; and a plastic retaining ring to secure the roller ball to the body of the marking instrument. The roller ball may be configured to rotate freely in all directions within the retaining ring, allowing for complete freedom of movement while marking with liquid paint. Additionally, the compressible plastic body of the marking instrument may include a reservoir that holds a marking liquid, such as the liquid paint, in a free state. This reservoir may be refillable, in one embodiment, and may be used to gradually dispense a variety of marking fluids, such as hydrated chalk paint.

In some embodiments, when a user squeezes the body of the roller-ball marking instrument, the paint may be pressurized slightly and transferred from the reservoir, through an opening in the retaining ring, and onto the fibrous, spherical roller ball. Accordingly, as the user moves the marker across a surface, the fibrous, spherical roller ball rotates within a cavity of the retaining ring, transferring the paint from the reservoir out onto the marking surface. A one-way valve may be included on the body of the marking instrument to allow air to be drawn into the reservoir to prevent suction from building within the body as paint is emptied from the reservoir and dispensed via the fibrous roller ball onto the drawing surface. Embodiments of the invention also include a method for assembling a roller-ball marking instrument and a system for delivering paint using a compressible body with a reservoir storing paint; a fibrous, spherical roller ball for transferring the paint to a drawing surface; and a retaining ring for securing the roller ball to the compressible body.

DESCRIPTION OF THE DRAWINGS

Illustrative embodiments of the invention are described in detail below with reference to the attached drawing figures, and wherein.

DETAILED DESCRIPTION

Figure 1:
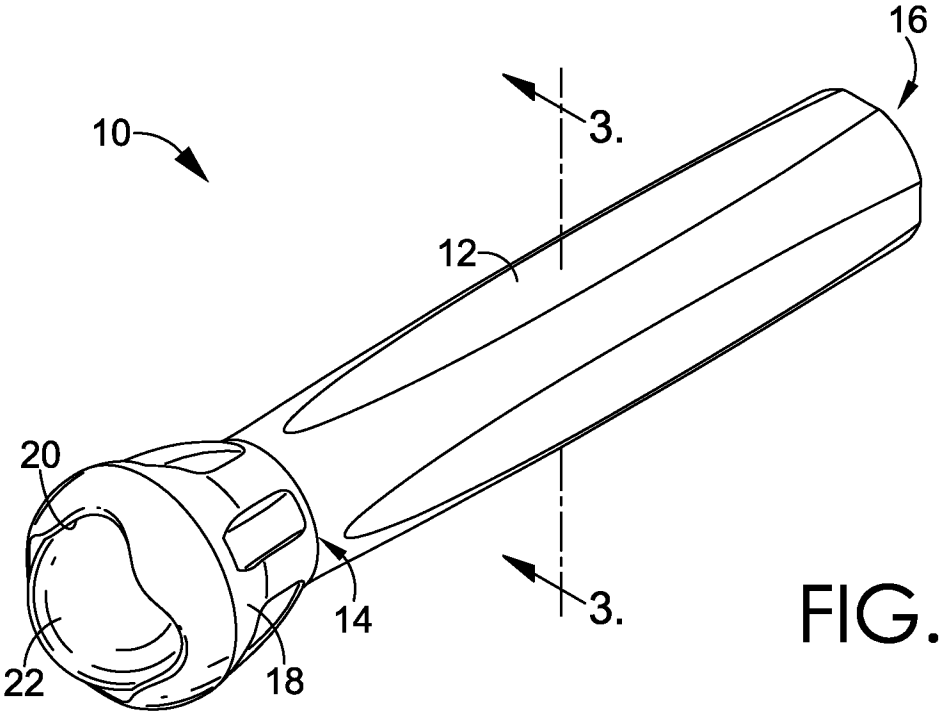
FIG. 1 is a perspective view of a roller-ball marking instrument, in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various disclosed steps unless and except when the order of individual steps is explicitly described.

Embodiments of the invention include, among other things, a roller-ball marking instrument for use with paint comprising: a body containing a first end and a second end; a reservoir enclosed by the body, said reservoir filled with a paint; a retaining ring coupled to the first end of the body; and a spherical roller ball configured to transfer the paint in the reservoir to a writing surface, wherein the spherical roller ball comprises a fibrous material and is freely rotatable within a hollow center of the retaining ring.

Embodiments of the invention also include a method for assembling a roller-ball marking instrument, wherein the method comprises: providing a housing with a first end and a second end, wherein at least a portion of the first end of the housing is open and wherein the housing comprises a reservoir; filling the reservoir of the housing with an amount of paint; coupling a first retaining ring with a body end and a roller-ball end to the housing at the first end of the housing and the body end of the first retaining ring, wherein the roller-ball end of the first retaining ring has a concave surface, forming an inverted dome-shaped center; positioning a fibrous, spherical roller ball in the inverted dome-shaped center of the first retaining ring; and coupling a second retaining ring to the first retaining ring at the roller-ball end of the first retaining ring, wherein the second retaining ring is configured to form an open-ended chamber with the first retaining ring and wherein at least a portion of the spherical roller ball protrudes through a hollow center of the second retaining ring.

Another embodiment includes a system for paint delivery. The paint-delivery system may comprise: a paint reservoir that includes a reservoir body for storing an amount of paint; a fibrous roller ball adjacent to the paint reservoir for applying the amount of paint to a writing surface; and a retaining ring for coupling the roller ball to the reservoir, the retaining ring comprising a first end, a second end, and a center cavity holding the roller ball, wherein the first end is adjacent to the paint reservoir; the second end contains an opening through which a portion of the roller ball protrudes; and the roller ball is freely rotatable within the center cavity of the retaining ring.

With reference now to the figures, apparatus, methods and systems for providing a roller-ball marking instrument for use with paint are described in accordance with embodiments of the invention. Various embodiments are described with respect to the figures in which like elements are depicted with like reference materials.

As depicted in FIG. 1, embodiments of the invention include a roller-ball marking instrument 10 that includes a body 12 having a first end 14 opposite a second end 16, and a hollow interior (not shown in FIG. 1). In the embodiment illustrated by FIG. 1, the body 12 comprises a cylindrical shape, but it is contemplated that the body 12 may comprise various other shapes, such as a spherical body having a hollow interior, or a pyramidal shape having a hollow interior. In some aspects, the first end 14 is opposite the second end 16 along a central, longitudinal axis of the body 12.

At the first end 14, the body 12 may be coupled, directly or indirectly, to a hollow retaining ring 18, such as a retaining ring 18 having an internal cavity with at least a portion of a concave feature for receiving a spherical object. In some embodiments, the body 12 may be removeably coupled to the retaining ring 18 such that different features may be coupled to the retaining ring 18 at different times. Additionally, a fibrous, spherical roller ball 22 may be positioned inside the hollow retaining ring 18, according to some embodiments. In further aspects, as shown in FIG. 1, the hollow retaining ring 18 may include a roller-ball opening 20 through which at least a portion of roller ball 22 protrudes. Accordingly, the retaining ring 18 may be configured to enclose at least a portion of a roller ball 22 within a concave cavity, and secure such roller ball 22 during manipulation of the roller-ball marking instrument 10.

In one embodiment, the roller ball 22 includes a textured, exterior surface, such as a covering on at least a portion of the roller ball 22. In some aspects, the covering on the exterior surface of the roller ball 22 includes at least one layer of applied flocking, such as an outer coating made from one or more fibrous materials. Such fibrous material may include a foamed plastic polymer material; a polyester sponge; a wool felt material; an acrylic felt material; a multi-component, fibrous material; or another fibrous material configured to transfer a paint solution from the reservoir of the body 12 to a writing surface adjacent the roller ball 22. Accordingly, various other fibrous materials with varying degrees of loft, absorbency, grain, texture, thickness, compressibility, and/or consistency may also be used. In one embodiment, the roller ball 22 is comprised of a single, fibrous material. But it is also contemplated that the roller ball 22 may be made by covering a non-fibrous spherical object, like a spherical-surface ball structure made of metal, rubber, or other non-absorbent material, with a fibrous material as an outer coating, such as felt.

Additionally, embodiments may include one or more surface features on the texturized and/or fibrous outer surface of the roller ball 22, such as one or more seamed features on the exterior surface of the roller ball 22. The seamed features may act as flow channels for transferring the paint solution, dispersing an amount of paint solution around the surface of the roller ball 22, maintaining movement of the roller ball 22 within the retaining ring 18, and/or maintaining fluid contact between the roller ball 22 and the retaining ring 18. As such, one or more features of an internal component or an external component of the spherical roller ball 22 may be optimized to provide sufficient flow of ink from the body 12 to a writing surface, via the roller-ball opening 20 of the retaining ring 18.

Figure 2:
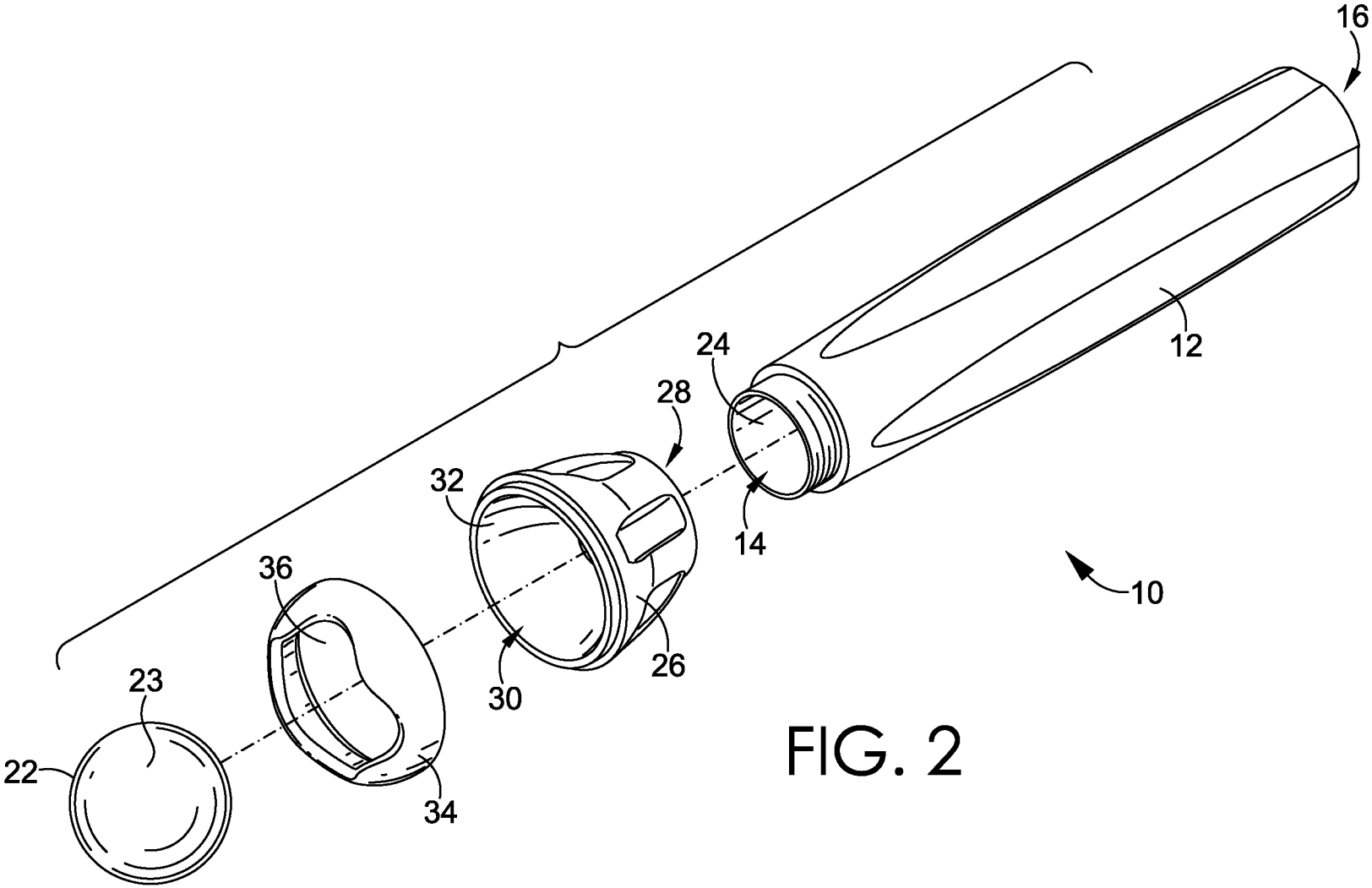
FIG. 2 is an exploded perspective view of the roller-ball marking instrument of FIG. 1, in accordance with an embodiment of the invention.

As depicted in FIG. 2, in some embodiments of this invention, the body 12 may be coupled to a first retaining ring portion 26 at the first end 14 of the body 12. In exemplary embodiments, the first retaining ring portion 26 may be coupled to the first end 14 of the body 12 via an attachment mechanisms, such as a screw mechanism. In other embodiments, other coupling mechanism may be used, such as a removable coupling mechanism allowing a user to attach and detach the first retaining ring portion 26 with respect to the first end 14. In some embodiments, the body 12 may include an opening 24 at its first end 14. As such, liquid paint may flow out of the body 12 and through the retaining ring 18 via the opening 24, according to some embodiments.

In one embodiment of the invention, the first retaining ring portion 26 may include a body end 28 opposite a roller-ball end 30. In one aspect, at least a portion of the first retaining ring portion 26 may include a concave surface configured to secure at least a portion of the roller ball 22. For example, as shown in FIG. 2, the roller-ball end 30 may include a concave surface 32 that forms an inverted-dome shape corresponding to the spherical shape of the roller ball 22. In one aspect, at least a portion of the roller ball 22 may be positioned adjacent the concave surface 32 of the first retaining ring portion 26. In further embodiments, the roller ball 22 may correspond to an internal contour of the concave surface 32 while maintaining a minimum distance between the roller ball 22 and the concave surface 32 that permits rotation of the roller ball 22 inside the retaining ring 18, and transfer of liquid paint as applied onto a surface via the roller ball 22 fibrous outer surface.

At its roller-ball end 30, the first retaining ring portion 26 may be coupled to a second retaining ring portion 34, according to embodiments of the invention. In some embodiments, the first retaining ring portion 26 may be coupled to the second retaining ring portion 34 via a screw mechanism, but other coupling mechanisms may be used. In one aspect, the second retaining ring portion 34 includes a hollow center 36. The hollow center 36 may include an internal surface corresponding to the concave surface 32 of the first retaining ring portion 26. In some embodiments, when the roller ball 22 is positioned on the concave surface 32 of the first retaining ring portion 26 and the second retaining ring portion 34 is coupled to the first retaining ring portion 26, at least a portion of the roller ball 22 protrudes through the hollow center 36 of the second retaining ring portion 34. In one aspect, based on positioning the roller ball 22 within the first retaining ring portion 26 and the second retaining ring portion 34, the fibrous surface 23 of the roller ball 22 is configured to transfer liquid paint, such as chalk paint, from the reservoir of the body 12, through the retaining ring 18, and onto a surface adjacent the roller ball 22.

Figure 3:
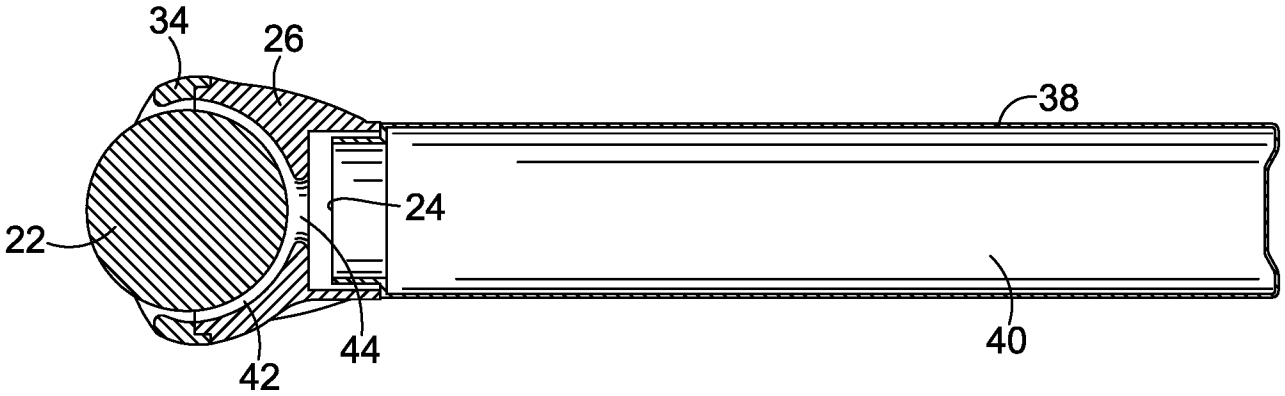
FIG. 3 is a cross-sectional side view of the roller-ball marking instrument of FIG. 1, in accordance with an embodiment of the invention.
Figure 4:
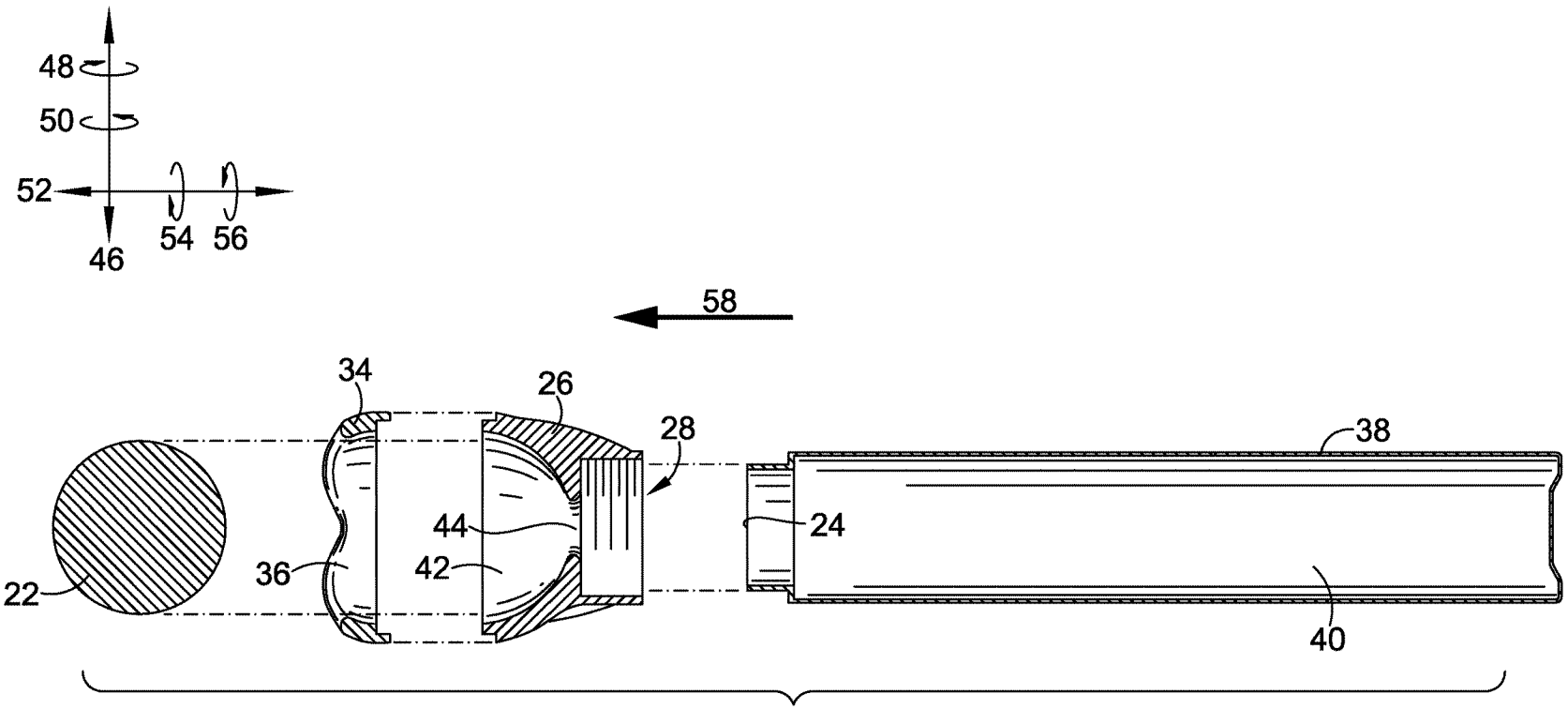
FIG. 4 is an exploded view of the cross-sectional side view of the roller-ball marking instrument in FIG. 3, in accordance with an embodiment of the invention.

As shown in FIGS. 3-4, the body 12 may be comprised of an outer casing 38 and a reservoir 40 that can store a liquid marking product for applying to a surface, such as paint. In some embodiments, a chalk paint is used, but various other types of paint may also be used. For example, a powder combined with a liquid to provide a solubilized liquid chalk paint may be secured within the reservoir 40. In one embodiment, paint from the reservoir 40 moves toward the roller ball 22, as shown by the arrow 58 in FIG. 4, through the opening 24 on body 12. The first retaining ring portion 26, which is coupled to body 12, may have an opening 44 at its body end 28 that receives the paint from the reservoir 40, in one embodiment of the invention. After paint flows through opening 44 of the first retaining ring portion 26, paint may be transferred to the roller ball 22 that is secured between the first retaining ring portion 26 and the second retaining ring portion 34. Accordingly, in some embodiments, the roller ball 22 may be positioned in a cavity 42 formed by coupling the first retaining ring portion 26 and the second retaining ring portion 34. In one aspect, the roller ball 22 is rotatably positioned inside the cavity 42, permitting both rotation of the roller ball 22 and flow of paint across at least a portion of the fibrous surface 23 of the roller ball 22 and onto a writing surface.

In some embodiments, the body 12 may be comprised of a compressible and/or deformable material, and paint may be forced to move toward the roller ball when a user squeezes the compressible body 12. Accordingly, the amount of paint that is moved onto the roller ball may be controlled by the amount of compression of the body 12. Embodiments of the body 12 may be constructed from one or more plastic materials, such as high-density polyethylene (HDPE) or low-density polyethylene (LDPE). For example, in one embodiment, the body 12 may be comprised of approximately 50% HDPE and approximately 50% LDPE, and in another embodiment, the body 12 may be comprised of approximately 80% HDPE and approximately 20% LDPE. It is contemplated, however, that other suitable combinations or materials may be used to construct the compressible body 12. Additionally, as will be understood, other mechanisms, aside from a compressible body 12, may be used to cause the paint to move towards the roller ball 22 in the direction shown by the arrow 58. Further, in an exemplary embodiment, the body 12 may include a one-way valve to allow air to be drawn into the reservoir 40 to prevent suction from building within the reservoir 40 as paint is emptied from the reservoir 40. In one aspect, the valve may be located at the second end 16 of the body 12.

In some embodiments, the roller ball 22 may be freely rotatable within cavity 42, meaning that roller ball 22 can rotate along at least two axes within the cavity 42. For example, in FIG. 4, a vertical axis 46 is provided, around which the roller ball 22 can rotate clockwise 48 and counter-clockwise 50, while a longitudinal axis 52 is provided around which the roller ball 22 can rotate clockwise 54 and counter-clockwise 56. In some embodiments, additional axes are provided, around which the roller ball 22 can rotate.

According to embodiments of the invention, the free rotation of the roller ball 22 allows at least a portion of the roller ball 22 to be saturated with paint at the opening 44 of the first retaining ring portion 26 and transfer the paint to a writing surface when the roller ball 22 rotates, with the saturated portion of the roller ball 22 protruding through the hollow center 36 of the second retaining ring portion 34. The free rotation may also create greater mobility of the roller ball 22 along a writing surface. As such, in some aspects, a user may paint in multiple directions with the roller ball 22 while holding the body 12 in a consistent position. In other words, the user need not rotate their grip with respect to the body 12, or angle the of the device with respect to a marking surface, in order to facilitate contact between the roller ball 22 and the marking surface in one or more directions.

After the paint has been used, a user may refill the reservoir 40 with the same or different type or color of paint according to one embodiment of the invention. In one aspect, the reservoir 40 may be refilled by removing the retaining ring 18 and filling the reservoir 40 from the opening 24 at the first end 14 of the body 12. In other embodiments, the reservoir 40 may be refilled from additional/alternative openings elsewhere on the body 12. Alternatively, additional or different paint may be used by replacing the body 12 with a new body having a reservoir filled with the same or different type or color of paint and coupling the new body to the retaining ring 18. In this way, the bodies are interchangeable in that different disposable paint-filled bodies may be used with the same retaining ring 18 and roller ball 22.

Figure 5A:
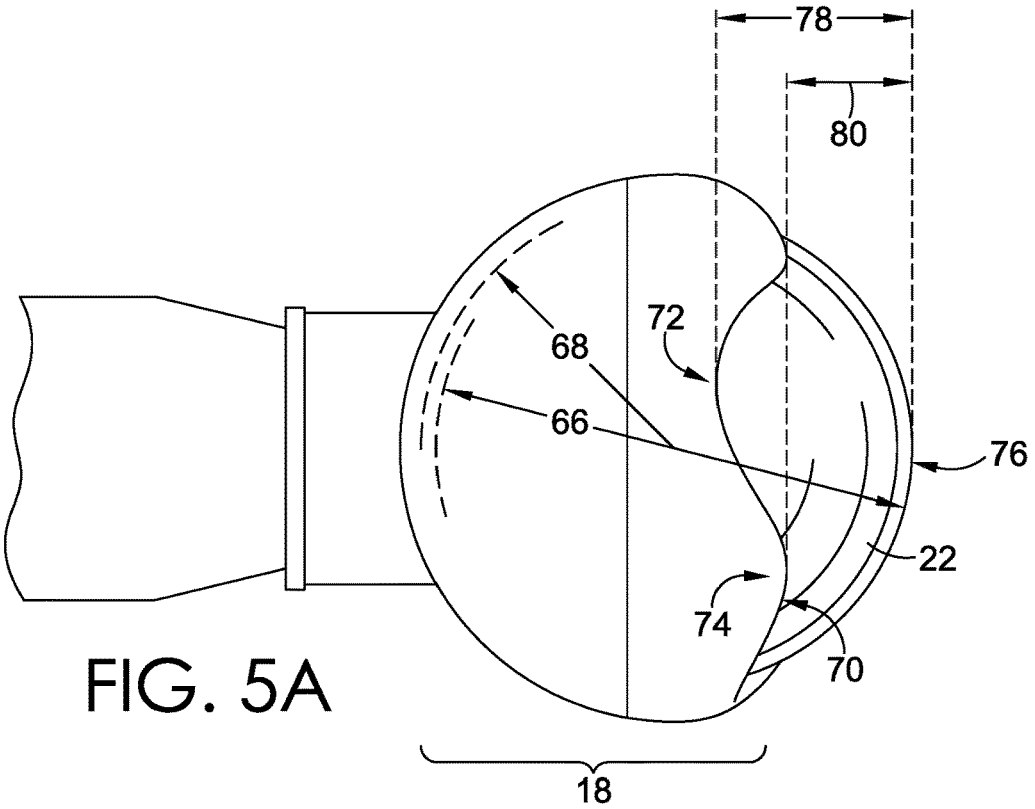
FIGS. 5A-5B are an expanded side view and an expanded top view of the roller-ball marking instrument, in accordance with an embodiment of the invention.
Figure 5B:
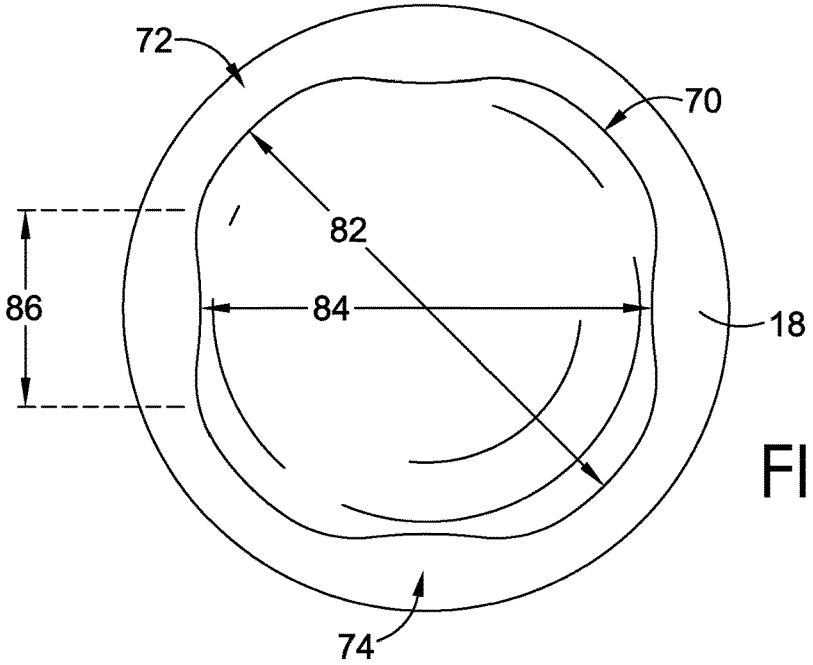

Turning to FIGS. 5A-5B, the roller ball 22 and the cavity 42 within the retaining ring 18 may be of various dimensions. For instance, in some embodiments, the diameter 66 of the roller ball 22 may range from about 1.5 inches to about 2.75 inches. Specifically, the diameter 66 of the roller ball 22 may be 2 inches. But in other embodiments, the diameter 66 of the roller ball 22 may be a length that is not within the range of 1.5 inches to 2.75 inches. Additionally, in some embodiments, the radius 68 of the cavity 42 within the retaining ring 18 may be 1.06 inches, but the radius 68 may be longer or shorter in alternative embodiments.

Further shown in FIGS. 5A-5B is the shape of one embodiment of the retaining ring 18. The retaining ring 18 may have a roller-ball edge 70 that creates the roller-ball opening 20 of the retaining ring 18. The roller-ball edge 70 of the retaining ring 18 may be curved with a serpentine shape such that the roller-ball edge 70 includes at least one valley portion 72 and at least one peak portion 74. In the embodiment depicted in FIGS. 5A-5B, there are four valley portions 72 alternating with four peak portions 74, but other combinations may be provided in other embodiments. The heights of the peak portions 74 and the valley portions 72 may vary with respect to the roller ball 22. For instance, in FIG. 5A, the distance 78 between a distal edge 76 of the roller ball 22 and the valley portion 72 of the roller-ball edge 70 may be 0.625 inches, whereas, the distance 80 between the distal edge 76 of the roller ball 22 and the peak portion 74 of the roller-ball edge may be 0.45 inches. Other distances may be used in other embodiments. In some aspects, a threshold distance 80 between the distal edge 76 of the roller ball 22 and the peak portion 74 along the serpentine roller-ball edge 70 is provided to secure the roller ball 22 from falling out of the retaining ring 18, while at the same time, exposing a desired surface area of the roller ball 22.

FIG. 5B represents a top view of the roller-ball marking instrument 10 to further illustrate the curved roller-ball edge 70. As explained above, in the embodiment shown, the roller-ball edge 70 comprises four valley portions 72 alternating with four peak portions 74. In such an embodiment, the distance 82 between the two opposing valley portions 72 across the roller ball 22 may be 2.05 inches, and the distance 84 between the two opposing peak portions 74 across the roller ball 22 may be 1.75 inches. Further, the distance 86 between a point on the roller-ball edge 70 where a peak portion 74 begins and the point on the roller-ball edge 70 where a peak portion 74 ends may be 1 inch, but other distances may present in other embodiments.

In some embodiments, the steepness of the curvature forming the peak portions 74 and/or the valley portions 72 may vary than what is depicted in FIGS. 5A-5B. Similarly, in some embodiments not illustrated, the apex of the curve defining one or more peak portions 74 may be flattened such that the peak portions 74 do not have a smooth curvature shape. A flattened curve on the peak portions 74 may expose more surface area of the roller ball 22 to a writing surface while keeping the roller ball 22 coupled to the retaining ring 18.

Figure 6:
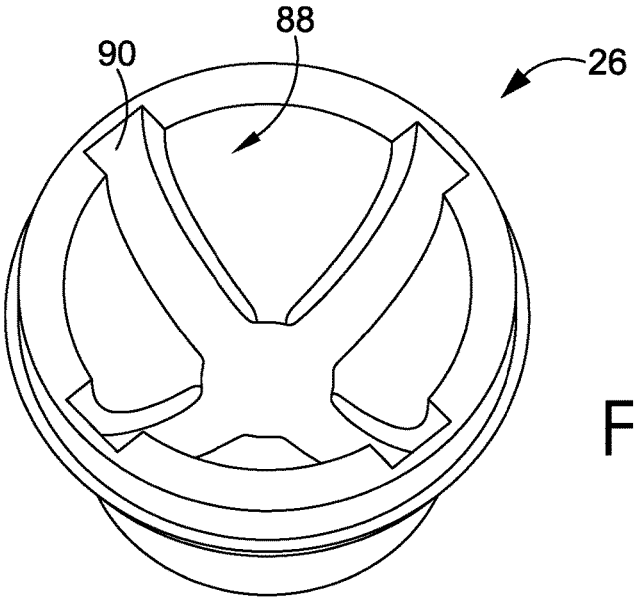
FIG. 6 is a perspective view of a first-retaining ring portion of the roller-ball marking instrument, in accordance with an embodiment of the invention.
Figure 7:
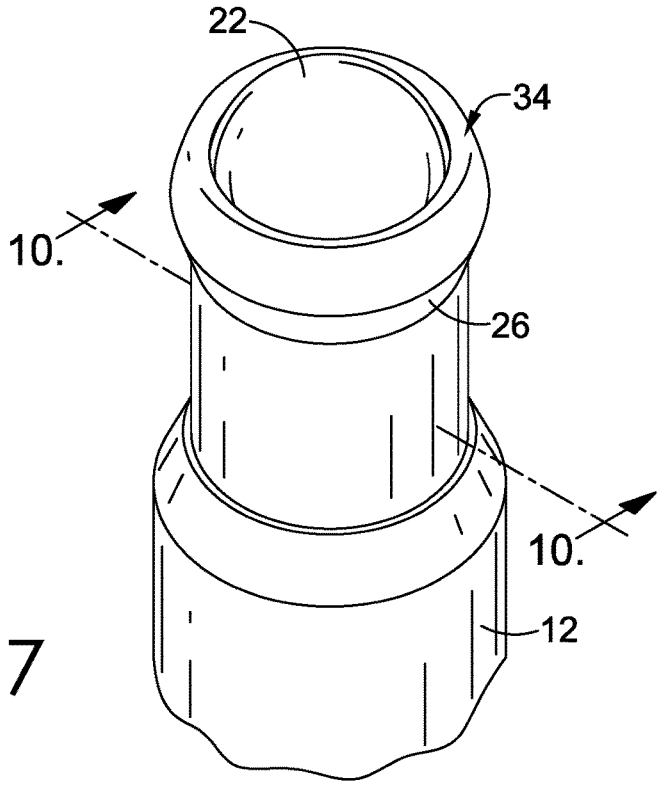
FIG. 7 is an expanded perspective view of the roller-ball marking instrument, in accordance with an embodiment of the invention.

Additionally, various textures may be provided on the retaining ring 18. For instance, in the embodiment provided in FIG. 2, the concave surface 32 of the first retaining ring portion 26 may comprise a smooth surface. In other embodiments, such as the one provided in FIG. 6, the interior surface 88 of the first retaining ring portion 26 may contain one or more grooves 90 or other indentions that would help to break up the liquid paint within the cavity 42 in the retaining ring 18. Alternatively, the interior surface 88 of the retaining ring 18 may contain ribs or other projections.

Figure 8:
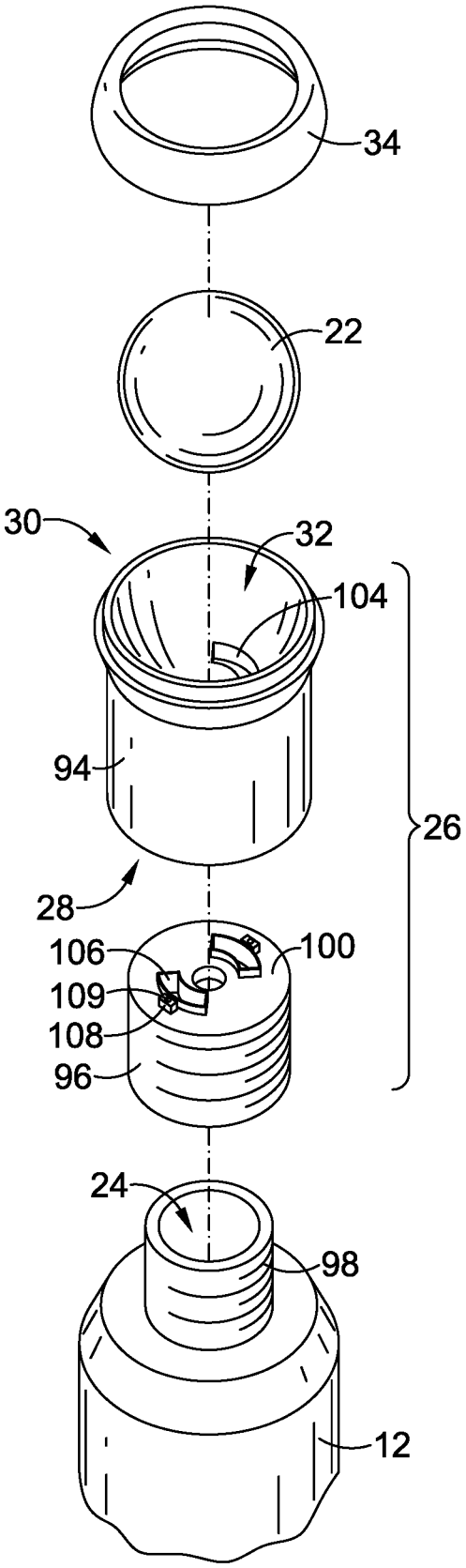
FIG. 8 is a top-perspective exploded view of a twist collar mechanism on the roller-ball marking instrument, in accordance with an embodiment of the invention.
Figure 9:
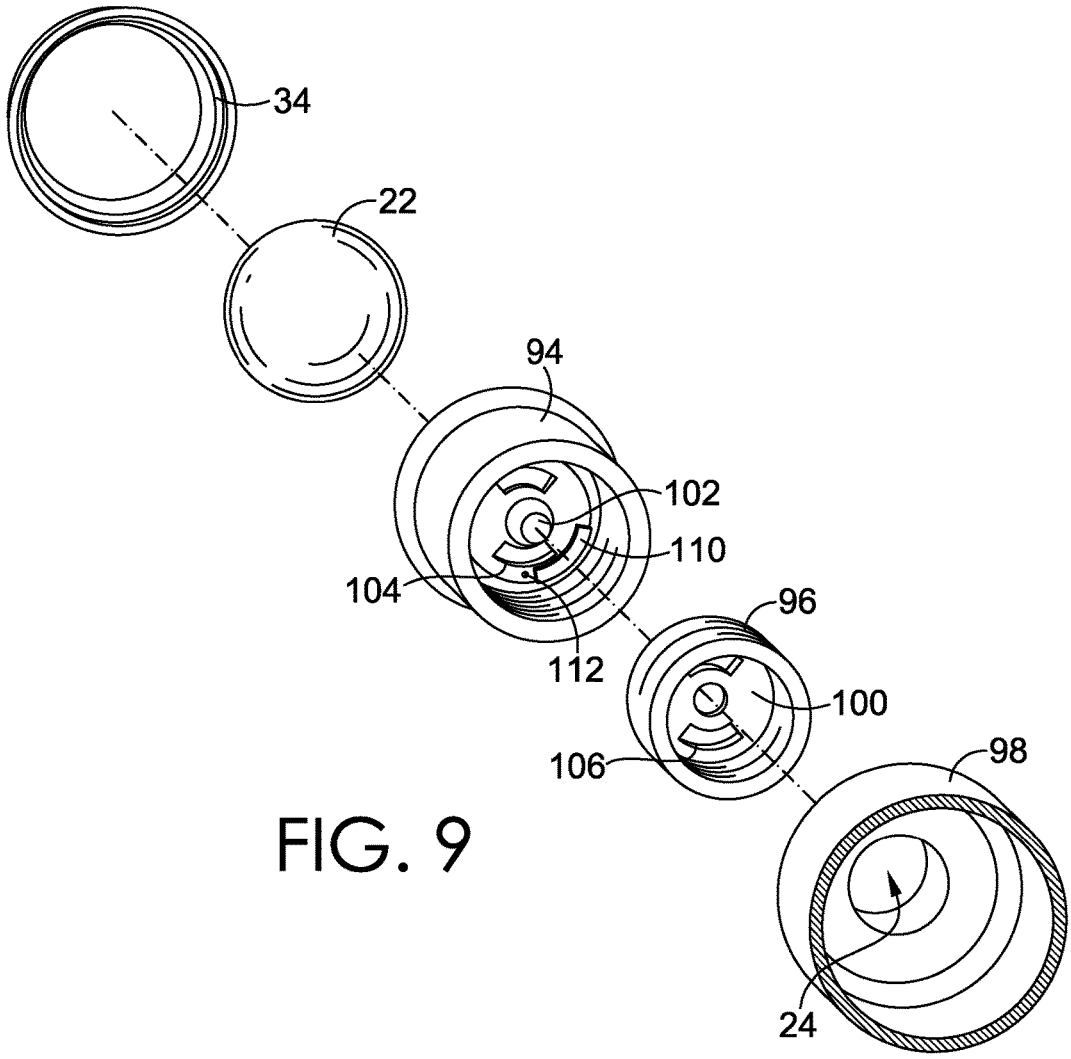
FIG. 9 is a bottom-perspective exploded view of a twist collar mechanism on the roller-ball marking instrument, in accordance with an embodiment of the invention

Lastly, when not in use, it may be desirable to prevent paint from further saturating the roller ball 22 or from leaking from the roller-ball marking instrument 10. A variety of integrated closures may be used. FIGS. 7-13 provide one embodiment with a twist collar mechanism 92. In this embodiment, the retaining ring 18 may comprise a first retaining ring portion 26 and a second retaining ring portion 34 with the first retaining ring portion 26. As shown in FIG. 8, the first retaining ring portion 26 may include an exterior collar 94 and an interior collar 96. The interior collar 96 may be placed around a neck 98 of the body 12 that leads to the opening 24 of the body 12. The exterior collar 94 may attach to the second retaining ring portion 34 and include a body end 28 opposite a roller-ball end 30. At the roller-ball end, the exterior collar 94 may have a concave surface 32 corresponding to the spherical shape of the roller ball 22. At the body end 28, the exterior collar 94 may be rotatably coupled to interior collar 96.

The interior collar 96 may include wall 100 that partially covers the opening 24 of the body 12 of the roller-ball marking instrument 10 when the interior collar 96 is coupled to the neck 98 of the body 12. The exterior collar 94 may have a locking projection 102 that frictionally engages with the wall 100 of the interior collar 96. It is contemplated, however, that the locking projection 102 and the wall 100 of the interior collar 96 may be rotatably coupled using other suitable mechanisms. The exterior collar 94 may include at least one exterior-collar paint opening 104 on an inferior portion of the concave surface 32.

The exterior-collar paint opening 104 may be configured to align with at least one interior-collar paint opening 106 on the wall 100 of the interior collar 96. The wall 100 of the interior collar 96 may include raised ribs extending around the perimeter of the interior-collar paint openings 106. The embodiment shown in FIGS. 8-13 has two opposing exterior-collar paint openings 104 and two opposing interior-collar paint openings 106.

Figure 10:
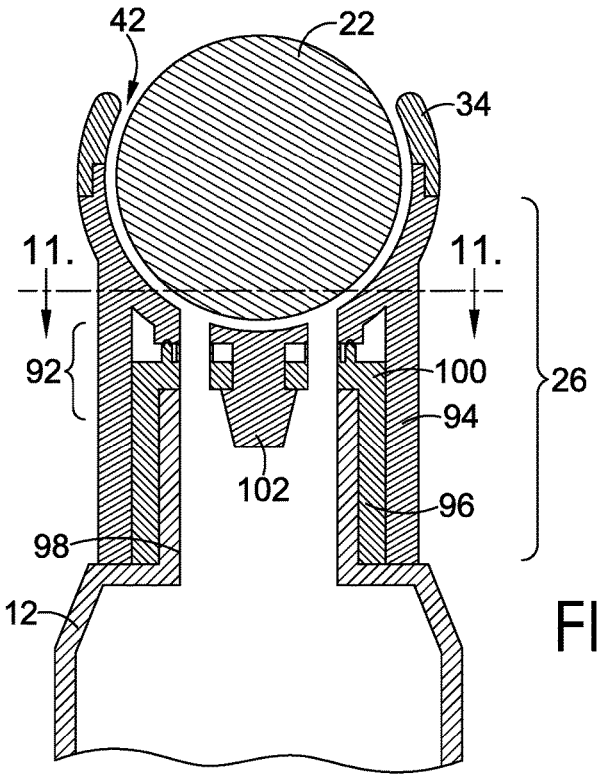
FIG. 10 is a cross-sectional side view, taken at line 10 on FIG. 7, of the twist collar mechanism on the roller-ball marking instrument in an open position, in accordance with an embodiment of the invention
Figure 11:
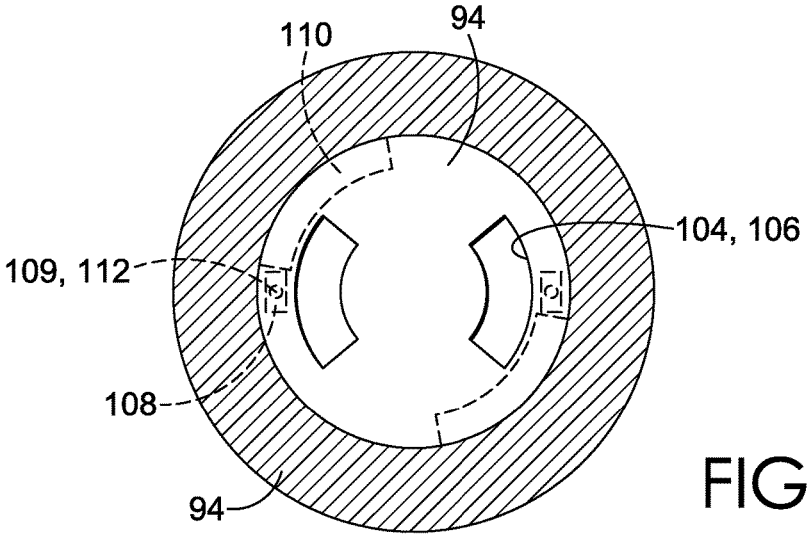
FIG. 11 is a cross-sectional, top view, taken at line 11 on FIG. 10, of the twist collar mechanism in an open position, in accordance with an embodiment of the invention.

FIGS. 10-11 depict the twist collar mechanism 92 when it is in an open position. In the open position, the exterior-collar paint openings 104 are aligned with the interior-collar paint openings 106. Paint from the reservoir 40 in the body 12 can move freely from the opening 24 of the body 12 to the cavity 42 within the retaining ring 18 to reach the roller ball 22.

As shown in the cross-sectional, top view provided in FIG. 11, the wall 100 of the interior collar 96 may have locking lugs 108 positioned so that the locking lugs 108 contact stop ribs 110 on the exterior collar 94. The contact between the locking lugs 108 and one end of the stop ribs 110 prevents the exterior collar 94 from rotating further.

Similarly, the exterior collar 94 may have a raised snap bump 112 adjacent each of the stop ribs 110 and positioned to mate with a detent 109 on each locking lug 108 of the interior collar 96 when the twist collar mechanism 92 is in an open position. The snap bumps 112 on the exterior collar 94 may frictionally engage the detents 109 on the interior collar 96 to prevent the exterior collar 94 from rotating out of the open position too easily or inadvertently. When the snap bumps 112 engage and disengage with the detents 109, the user may feel a snap or other proprioceptive feedback to indicate that the twist collar mechanism 92 is moving in and out of the open position. In alternative embodiments not illustrated, the locking lugs 108 do not include detents, and the snap bumps 112 may be positioned on the exterior collar 94 so that an entire locking lug 108 may pass over a snap bump 112 before contacting a stop rib 110. When in the open position, each locking lug 108 on the interior collar 96 may be positioned between a snap bump 112 and a stop rib 110 on the exterior collar 94.

Figure 12:
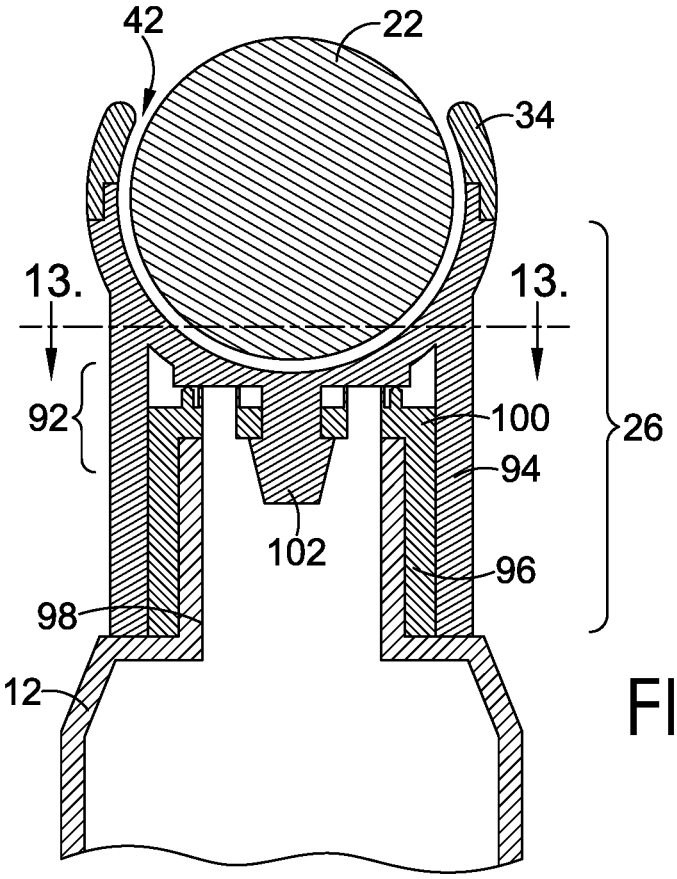
FIG. 12 is a cross-sectional side view, taken at line 10 on FIG. 7, of the twist collar mechanism on the roller-ball marking instrument in a closed position, in accordance with an embodiment of the invention.
Figure 13:
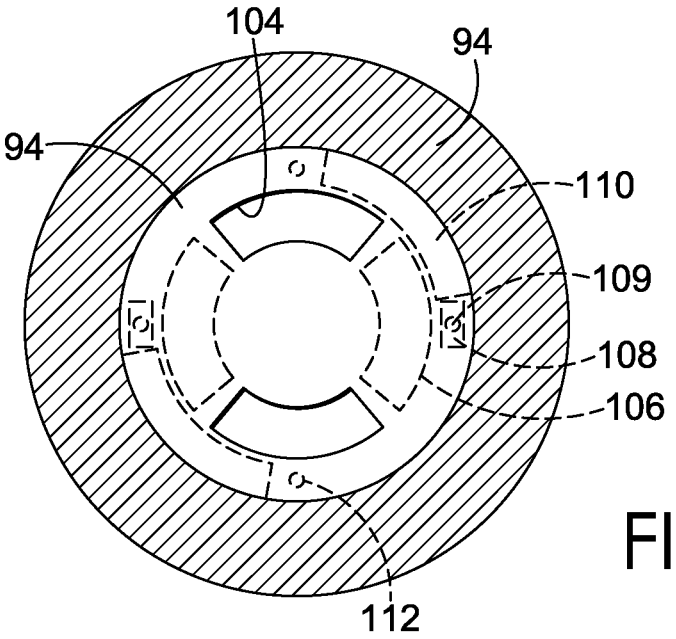
FIG. 13 is a cross-sectional, top view, taken at line 13 on FIG. 12, of the twist collar mechanism in a closed position, in accordance with an embodiment of the invention.

FIGS. 12-13 depict the twist collar mechanism 92 when it is in a closed position. As the exterior collar 94 is rotated around the interior collar 96, the exterior-collar paint openings 104 may move in relation to the interior-collar paint openings 106, such that the exterior-collar paint openings 104 are no longer aligned with the interior-collar paint openings 106. When the twist collar mechanism 92 is closed, there are no openings through which paint can move from the body 12 to the cavity 42 in the retaining ring 18. When the exterior collar 94 is rotated around the interior collar 96 from the open position to the closed position, the locking lugs 108 on the wall 100 of the interior collar 96 may contact with the other ends of the stop ribs 110 to prevent the exterior collar 94 from rotating further.

FIGS. 14-19 depict an alternative embodiment of the twist collar mechanism 92. With this alternative embodiment illustrated, the exterior collar 94 has three exterior-collar paint openings 104 configured to align with three interior-collar paint openings 106 on the wall 100 of the interior collar 96. There may also be a ring 114 positioned between the exterior collar 94 and interior collar 96. The ring 114 may be used to seal the internal mating surfaces of the exterior collar 94 and the interior collar 96. Additionally, the exterior collar 94 and the interior collar 96 may be coupled together with one or more screws 116 around which the exterior collar 94 and interior collar 96 can rotate when coupled together. It is also contemplated that alternative coupling mechanisms may be used to rotatably couple the exterior collar 94 and the interior collar 96.

Figure 14:
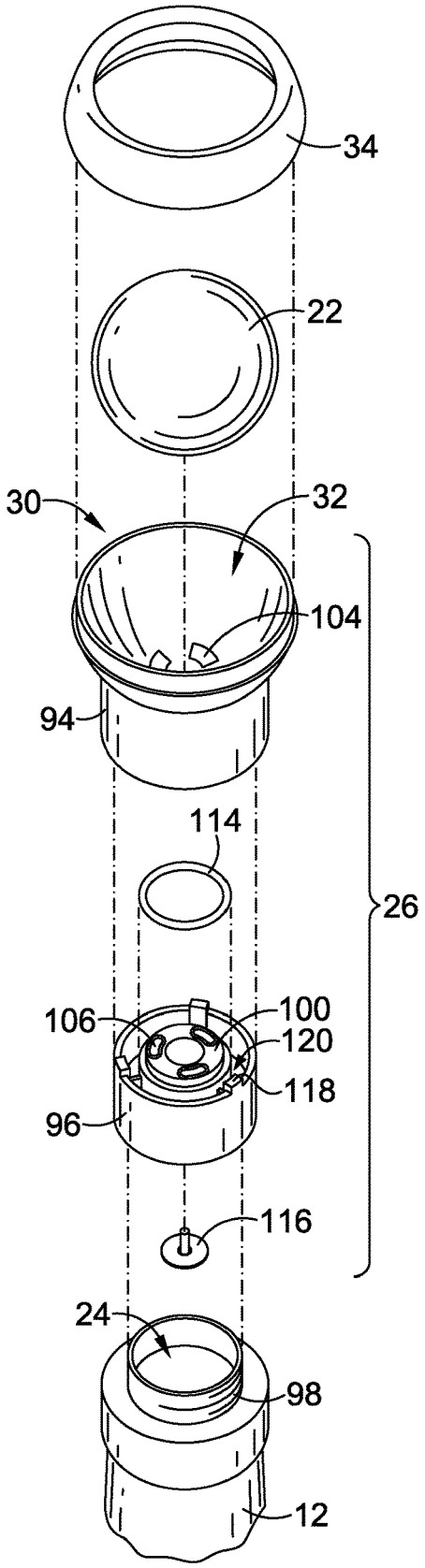
FIG. 14 is a top-perspective exploded view of a twist collar mechanism on the roller-ball marking instrument in a closed position, in accordance with an embodiment of the invention.

As shown in the embodiment in FIG. 14, the interior collar 96 may include one or more tabs 118 spaced along the perimeter of the interior collar 96. For example, FIG. 14 illustrates three tabs 118 evenly spaced along the perimeter of the interior collar 96. The exterior collar 94 may include one or more stop ribs 122, as shown in the cross-sectional view in FIG. 16) that are configured to slide within the spaces 120 between the tabs 118 of the interior collar 96 as a user rotates the exterior collar 94.

Figure 15:
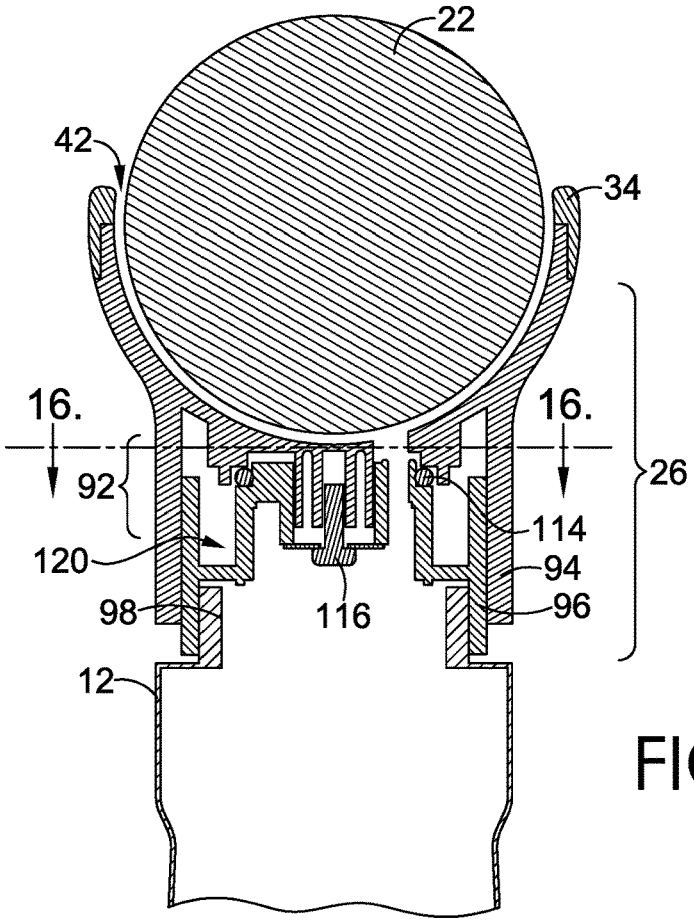
FIG. 15 is a cross-sectional side view, taken at line 10 on FIG. 7, of a twist collar mechanism of the roller-ball instrument in an open position, in accordance with an embodiment of the invention.
Figure 16:
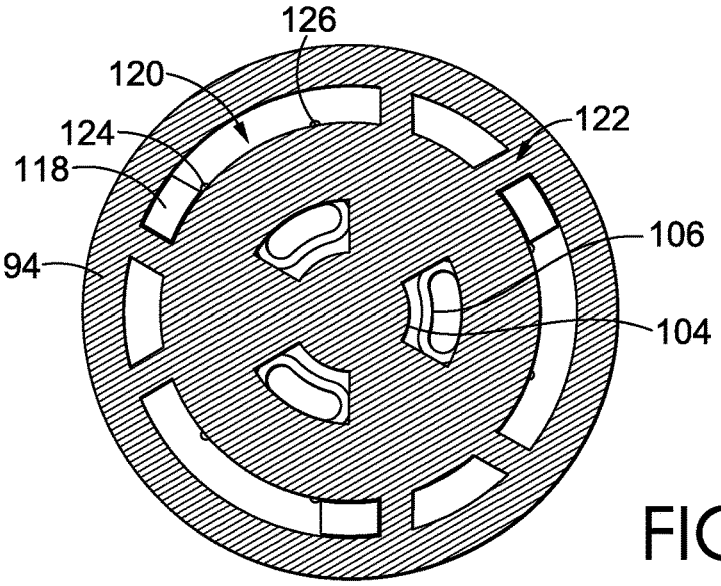
FIG. 16 is a cross-sectional, top view, taken at line 16 on FIG. 15, of the twist collar mechanism in an open position, in accordance with an embodiment of the invention.
Figure 17:
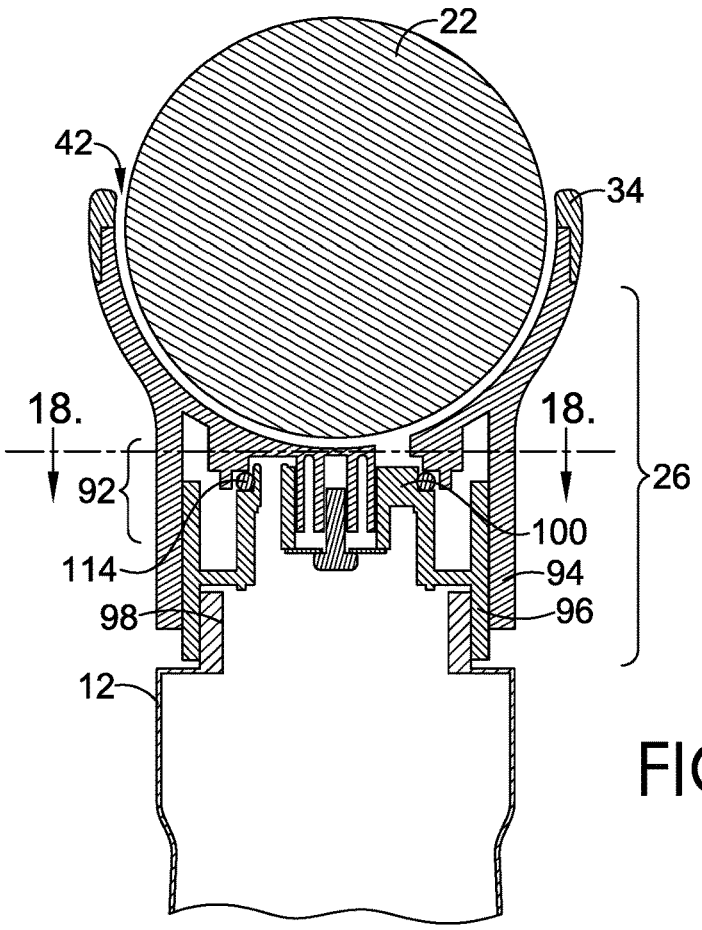
FIG. 17 is a cross-sectional side view, taken at line 10 on FIG. 7, of the twist collar mechanism of the roller-ball instrument in a closed position, in accordance with an embodiment of the invention.
Figure 18:
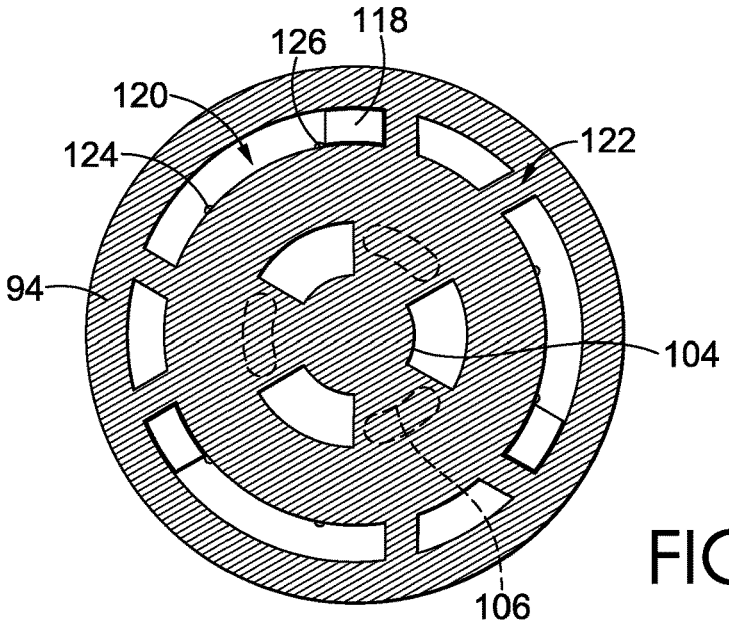
FIG. 18 is a cross-sectional, top view, taken at line 18 on FIG. 17, of the twist collar mechanism in a closed position, in accordance with an embodiment of the invention.

Turning to FIGS. 15 and 16, cross-sectional views showing the twist collar mechanism 92 in an open position are provided. In an open position, each tab 118 of the interior collar 96 is in contact with a stop rib 122 of the exterior collar 94. When in the open position, the exterior-collar paint openings 104 are aligned with interior-collar paint openings 106, allowing paint from the reservoir 40 in the body 12 to move freely from the body 12 to the cavity 42 within the retaining ring 18 to reach the roller ball 22.

As seen in FIG. 16, the exterior collar 94 may have raised snap bumps to provide a frictional force to keep the twist collar mechanism 92 from inadvertently moving out of a closed and/or open position. For example, there may be three open-position snap bumps 124 positioned adjacent each tab 118 of the interior collar 96 when in the open position such that each tab 118 is between a stop rib 122 and an open-position snap bump 124. In this way, the stop ribs 122 and the open-position snap bumps 124 prevent the exterior collar 94 from inadvertently rotating in either direction relative to the interior collar 96 when the roller-ball marking instrument 10 is being used.

To close the twist collar mechanism 92, a user may twist the exterior collar 94 with respect to the interior collar 96. In exemplary embodiments, the exterior collar 94 may be rotated clockwise and/or the interior collar 96 may be rotated counter-clockwise to move from the closed position shown in FIGS. 15 and 16 to the closed position shown in FIGS. 17 and 18. When rotating the exterior collar 94 with respect to the interior collar 96, the open-position snap bumps 124 may be moved passed the tabs 118 of the interior collar 96 with the use of a small amount of force. Each of the stop ribs 122 of the exterior collar 94 may continue to slide within the spaces 120 of the interior collar 96 until contacting another tab 118. When the stop rib 122 of the exterior collar 94 makes contact with the tab 118, the twist collar mechanism 92 will be in a closed position, and the user will not be able to continue rotating the exterior collar 94. In this way, the tabs 118 in FIGS. 14-18 are similar to the locking lugs 108 in FIGS. 8-13. When in the closed position, the exterior-collar paint openings 104 are not aligned with interior-collar paint openings 106 such that paint cannot move freely from the body 12 to the cavity 42 within the retaining ring 18.

In exemplary aspects, the exterior collar 94 may also include three close-position snap bumps 126. In the closed position, the tabs 118 of the interior collar 96 may be positioned between a close-position snap bump 126 and a stop rib 122. The close-position snap bump 126 may work similarly as the open-position snap bump 124 by providing frictional force to prevent the exterior collar 94 from being inadvertently rotated out of the closed position. To open the twist collar mechanism 92, the exterior collar 94 may be rotated in a counter-clockwise position with respect to the interior collar 96. The close-position snap bumps 126 may be first moved over the tabs 118 with a small amount of force, and the open-position snap bumps 124 may then be moved over the tabs 118 before the tabs 118 contact the stop ribs 122. Accordingly, both the open-position snap bumps 124 and the close-position snap bumps 126 prevent the twist collar mechanism 92 from rotating inadvertently while still allowing a user to easily move the twist collar mechanism 92 between an open and closed position. Additionally, as an open-position snap bump 124 or a close-position snap bump 126 is moved passed a tab 118, a user may feel a snap or similar proprioceptive feedback to indicate to the user that the twist collar mechanism 92 is securely in either an open or closed position.

While not shown, it is further contemplated that, in some embodiments, the retaining ring 18 may be configured to be coupled with a cap for covering the hollow center 36 and the portion of the roller ball 22 exposed through the hollow center 36 when the marking instrument is not in use. The cap may be coupled to the retaining ring 18 via a hinge or may be completely removable. In further embodiments, the cap may be coupled to either the first retaining ring portion 26 or the second retaining ring portion 34. In another embodiment, the cap may be a curved piece of material that slides between the retaining ring 18 and the roller ball 22. A cap may be used in conjunction with another integrated closure, such as the twist collar mechanism 92, or may be used by itself.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A roller-ball marking instrument for use with a paint comprising:

a body containing a first end and a second end;

a reservoir enclosed by the body, said reservoir filled with the paint;

a retaining ring coupled to the first end of the body, wherein the retaining ring comprises an exterior collar and an interior collar that is rotatably coupled to the exterior collar and configured to rotate from a first position to a second position relative to the external collar; and a spherical roller ball configured to transfer the paint in the reservoir to a writing surface, wherein the spherical roller ball comprises a fibrous material and is freely rotatable within a hollow center of the retaining ring, wherein the exterior collar comprises one or more openings and the interior collar comprises one or more openings configured to align with the one or more openings of the exterior collar when in the first position and configured to not align with the one or more openings of the exterior collar when in the second position.

2. The roller-ball marking instrument of claim 1, wherein the body comprises a plastic, compressible material.

3. The roller-ball marking instrument of claim 2, wherein the spherical roller ball becomes saturated with the paint based on a compression of the body comprising the plastic, compressible material.

4. The roller-ball marking instrument of claim 1, wherein the reservoir is refillable.

5. The roller-ball marking instrument of claim 1, wherein the paint is a chalk paint.

6. The roller-ball marking instrument of claim 1, wherein the retaining ring is coupled to the first end of the body through a screw mechanism.

7. The roller-ball marking instrument of claim 1, wherein the retaining ring comprises a first portion that is coupled to the first end of the body and second portion that is coupled to the first portion, the first portion comprising the interior collar and the exterior collar.

8. The roller-ball marking instrument of claim 7, wherein the first portion of the retaining ring and the second portion of the retaining ring form a partially enclosed cavity in which the roller ball is contained.

9. A method for assembling a roller-ball marking instrument, wherein the method comprises:

providing a housing with a first end and a second end, wherein at least a portion of the first end of the housing is open and wherein the housing contains a reservoir;

filling the reservoir of the housing with an amount of paint;

coupling a first retaining ring to the housing, the first retaining ring having a body end and a roller-ball end and the body end of the first retaining ring being coupled to the first end of the housing, wherein the roller-ball end of the first retaining ring has a concave surface, forming an inverted dome-shaped center;

positioning a fibrous, spherical roller ball in the inverted dome-shaped center of the first retaining ring; and coupling a second retaining ring to the first retaining ring at the roller-ball end of the first retaining ring, wherein the second retaining ring is configured to form an open-ended chamber with the first retaining ring and wherein at least a portion of the fibrous, spherical roller ball protrudes through a hollow center of the second retaining ring, wherein the first retaining ring comprises an exterior collar and an interior collar that is rotatably coupled to the exterior collar and configured to rotate from a first position to a second position relative to the exterior collar, and wherein the exterior collar comprises one or more openings and the interior collar comprises one or more openings configured to align with the one or more openings of the exterior collar when in the first position and configured to not align with the one or more openings of the exterior collar when in the second position.

10. The method of claim 9, wherein the amount of paint comprises a chalk paint.

11. The method of claim 9, wherein the housing is made of a compressible plastic.

12. The method of claim 9, wherein the roller ball is configured to rotate freely within the open-ended chamber formed by the first retaining ring and the second retaining ring.

13. The method of claim 9, wherein the first retaining ring is coupled to the housing via a screw mechanism.

14. The method of claim 9, wherein the second retaining ring is coupled to the first retaining ring via a screw mechanism.

15. A system for paint delivery, the system comprising:

a paint reservoir that includes a reservoir body for storing an amount of paint;

a fibrous, spherical roller ball adjacent to the paint reservoir for applying the amount of paint to a writing surface; and a retaining ring for coupling the roller ball to the paint reservoir, the retaining ring comprising a first end, a second end, and a center cavity holding the roller ball, wherein:

the first end is adjacent to the reservoir;

the second end contains an opening through which a portion of the roller ball protrudes; and the roller ball is freely rotatable within the center cavity of the retaining ring wherein the retaining ring comprises an exterior collar and an interior collar that is rotatably coupled to the exterior collar and configured to rotate from a first position to a second position relative to the exterior collar, and wherein the exterior collar comprises one or more paint openings and the interior collar comprises one or more paint openings configured to align with the one or more paint openings of the exterior collar when in the first position and configured to not align with the one or more paint openings of the exterior collar when in the second position.

16. The paint-delivery system of claim 15, wherein the reservoir body comprises a compressible plastic material.

17. The paint-delivery system of claim 15, wherein at least a portion of the amount of paint stored in the reservoir body is configured to move through an opening in the one or more paint openings in the exterior collar and the one or more openings in the interior collar and saturates at least a portion of the roller ball.

18. The paint-delivery system of claim 17, wherein paint is transferred to a writing surface when the at least a portion of the roller ball that is saturated in paint contacts the writing surface through the opening of the second end of the retaining ring.

* * * * *